US007575541B2

(12) United States Patent
Chen

(10) Patent No.: US 7,575,541 B2
(45) Date of Patent: Aug. 18, 2009

(54) SPINE STRETCH MACHINE

(76) Inventor: Samuel Chen, Flat M, 3 floor, Kaiser Estate Phase 3, Hok Yuen Street, Hunghom, Hong Kong, Kowloon (CN)

( * ) Notice: Subject to any disclaimer, the term of this patent is extended or adjusted under 35 U.S.C. 154(b) by 0 days.

(21) Appl. No.: 11/724,097

(22) Filed: Mar. 14, 2007

(65) Prior Publication Data

US 2008/0227610 A1 Sep. 18, 2008

(51) Int. Cl.
*A63B 26/00* (2006.01)

(52) U.S. Cl. ..... 482/144; 482/143; 482/145

(58) Field of Classification Search ..... 482/143–145
See application file for complete search history.

(56) References Cited

U.S. PATENT DOCUMENTS

| | | | | | |
|---|---|---|---|---|---|
| 2,413,133 | A * | 12/1946 | Aydelotte | 601/89 |
| 3,817,243 | A * | 6/1974 | Perrine | 601/24 |
| 3,895,623 | A * | 7/1975 | Mahlandt et al. | 601/26 |
| 4,372,551 | A * | 2/1983 | Yurdin | 482/57 |
| 4,723,537 | A * | 2/1988 | Parker, Jr. | 601/26 |
| 4,739,749 | A * | 4/1988 | Lindley | 606/244 |
| 5,031,905 | A * | 7/1991 | Walsh | 482/112 |
| 5,203,321 | A * | 4/1993 | Donovan et al. | 601/5 |
| 5,216,769 | A * | 6/1993 | Eakin | 5/620 |
| 5,320,641 | A * | 6/1994 | Riddle et al. | 606/243 |
| 5,474,520 | A * | 12/1995 | Bittikofer | 601/27 |
| 5,593,380 | A * | 1/1997 | Bittikofer | 601/27 |
| 5,738,636 | A * | 4/1998 | Saringer et al. | 601/5 |
| 5,860,899 | A * | 1/1999 | Rassman | 482/142 |
| 6,960,174 | B2 * | 11/2005 | Fenkel | 601/99 |
| 7,025,415 | B1 * | 4/2006 | Wu | 297/119 |
| 7,052,448 | B2 * | 5/2006 | Teeter | 482/144 |
| 7,081,073 | B1 * | 7/2006 | Smith | 482/145 |
| 7,121,985 | B2 * | 10/2006 | Cheng | 482/57 |
| 7,125,389 | B2 * | 10/2006 | Sin | 601/98 |
| 7,374,521 | B2 * | 5/2008 | Wang | 482/145 |
| 7,384,383 | B2 * | 6/2008 | Forcillo et al. | 482/140 |
| 2005/0010145 | A1 * | 1/2005 | Fenkell | 601/99 |
| 2006/0040810 | A1 * | 2/2006 | Chu | 482/142 |
| 2006/0040812 | A1 * | 2/2006 | Teeter | 482/144 |
| 2006/0189451 | A1 * | 8/2006 | Nelson | 482/57 |
| 2006/0194676 | A1 * | 8/2006 | Keiser | 482/92 |
| 2006/0282024 | A1 * | 12/2006 | Kondo | 601/24 |
| 2006/0293156 | A1 * | 12/2006 | Trees | 482/148 |
| 2007/0043308 | A1 * | 2/2007 | Lee | 601/34 |
| 2007/0099777 | A1 * | 5/2007 | Forcillo et al. | 482/142 |
| 2009/0054216 | A1 * | 2/2009 | Teeter | 482/144 |
| 2009/0054217 | A1 * | 2/2009 | Teeter | 482/144 |

* cited by examiner

*Primary Examiner*—Lori Amerson
(74) *Attorney, Agent, or Firm*—Clement Cheng

(57) ABSTRACT

A spine stretch machine, comprising: an inverting part and a back stretch part. The inverting part has a platform allowing a person to lie on it, a inversion motor to move the platform from horizontal to vertical, a feet anchor which is extendable driven by a leg adjustment motor, thus making the body upside down to stretch the spine. A safety release device in the inverting part can move the platform back to horizontal when the inversion motor is broken. The back stretch part has a back press unit which protrudes from the platform to press the back of the body and a second motor-driven unit which can drive the back press unit to roll back and forth alone the spine to massage the back, thus making the spine flexible.

18 Claims, 14 Drawing Sheets

SPINE STRETCH MACHINE

TECHNICAL FIELD

The present invention relates to exercise machines, especially machines which can stretch, press, and massage human spines.

BACKGROUND ART

As shown in FIG. 1, a prior art known inverting machine 10 can stretch spines and includes a foldable frame 11 and an inverting unit 12 which can invert upside down around its axis in the foldable frame 11. The foldable frame 11 has a middle connecting part 111 with a opening 1111 at its upper edge, a front stand 112, a hind stand 113, with the front stand 112 and the hind stand 113 connecting to the middle connecting part 111 through an axis, and a foldable post support 114 which connects the front stand 112 and the hind stand 113, thus making the front stand 112 and the hind stand 113 open up and stand on the ground. The inverting unit 12 has a platform 121 allowing a person to lie on it facing up, two handles 122 with axis 1221 in the opening 1111 in the middle connecting part 111, a leg extension part 123 extending from underneath the platform 121, and two feet stopper 124 attached to the leg extension part 123, making the inverting unit 12 rotate around axis 1221. When a user lies on platform 121 and inverts upside down, he can use feet stopper 124 to hold this position in order to stretch his spine using his body weight.

Although the above inverting machine 10 can stretch spines, it has following shortcomings: frame 11 is too fragile to withstand a heavy force, thus scaring users when they are inverted, even causing danger to the user if they don't operate it carefully enough. The inverting machine 10 uses feet stoppers 124 to hold the inverted position, so the force on the human body transfers from the shin bone to the thigh bone, then the rest of the force is applied to the spine. This reduced force on the spine can not stretch the spine efficiently and may cause leg injuries instead.

As shown in FIG. 2, a prior art known back arching machine 20 can stretch backs and includes a base 21 with two foldable stands 211, and a curving platform 22 allowing a person to lie on it on his back with two handles 23 connected to the side of the curving platform 22. The curving platform 22 is higher in the middle and lower on the ends, so when a user lies on the curving platform 22, the user will arch his whole back from waist above to stretch his back muscles.

Although above back arching machine 20 can stretch back muscles, it has following shortcomings: the curving platform 22 touches the whole back when a user lies on it, so its function is limited since it can neither stretch spines specifically, nor massage it dynamically. A user has to grab the handle 23 and use his waist muscle to life his upper body when he wants to get up from the curving platform 22, but this is usually impossible for weak patients or people with backache. The back arching machine 20 is not suitable for people recovering from sickness.

BRIEF SUMMARY OF THE INVENTION

The object of present invention is to provide a motor-driven machine to stretch, press and massage spines to assist either recovery from sickness or regular exercise.

This object is accomplished by the following design of a spine stretch machine: an inverting base part, and a back stretch part. The inverting part has a frame, an inversion motor, a gas shock, a safety release device, a platform, and a feet/foot anchor. The frame is connected to the platform through an axis. The inversion motor rotates an inversion linkage, which links the frame with the platform anterior to the axis, around a sliding bar to move the platform from horizontal to vertical around the frame axis. The gas shock linking the frame with the platform posterior to the axis makes the movement of inversion smoother. The safety release device consists of two safety release sliding rails parallel to each other on the frame, the sliding bar, and a safety spring. When the inversion motor is broken, the sliding bar sliding along the safety release sliding rails together with the safety spring can bring the platform from vertical back to horizontal. The platform has a rectangular opening where the spine lies when a person lies on it on his back. The feet anchor can be extended by a leg adjustment motor to suit users of different height. The back stretch part has a second motor-driven unit underneath the platform, a back press unit with a motor inside. The back press unit protruding through the rectangular opening is moved by the second motor-driven unit and rotated by the motor in the back press unit to press and massage the back of the body.

The present invention employs a motor-driven system to stretch spines using the inverting part, to press and massage spines and back muscles using the back stretch part, thus help recovery or exercise of the human back.

Back massager and stretching part has a second motor-driven unit underneath the platform, a back linage underneath the platform driven by the second motor-driven unit, a upper sliding rail connected the platform while parallel to the rectangular opening in the board, and a back press unit sliding along the upper sliding rail when moved by the second motor-driven unit through the back linage. The second motor-driven unit has an electrical motor, and a force outlet pulley. The back linage has a threaded linage parallel to the upper sliding rail, a pulley connected to the end of the threaded linage, and a belt around the pulley connected to the force outlet pulley. The back press unit includes a rolling base that can move forward and backward along the upper sliding rail, a threaded carrier that can move along the threaded linage, a motor inside the rolling base, a rotation frame which can rotate in the front of the rolling base, a linking bar inside the rolling base to rotate the rotation frame, and a rolling part connected to the rotation frame which protrudes from the board through the rectangular opening to press the back of the body. The rolling part includes two massage wheels on both sides, which rotates to provide press and massage to the back.

DETAILED DESCRIPTION OF THE INVENTION

Figure 1:
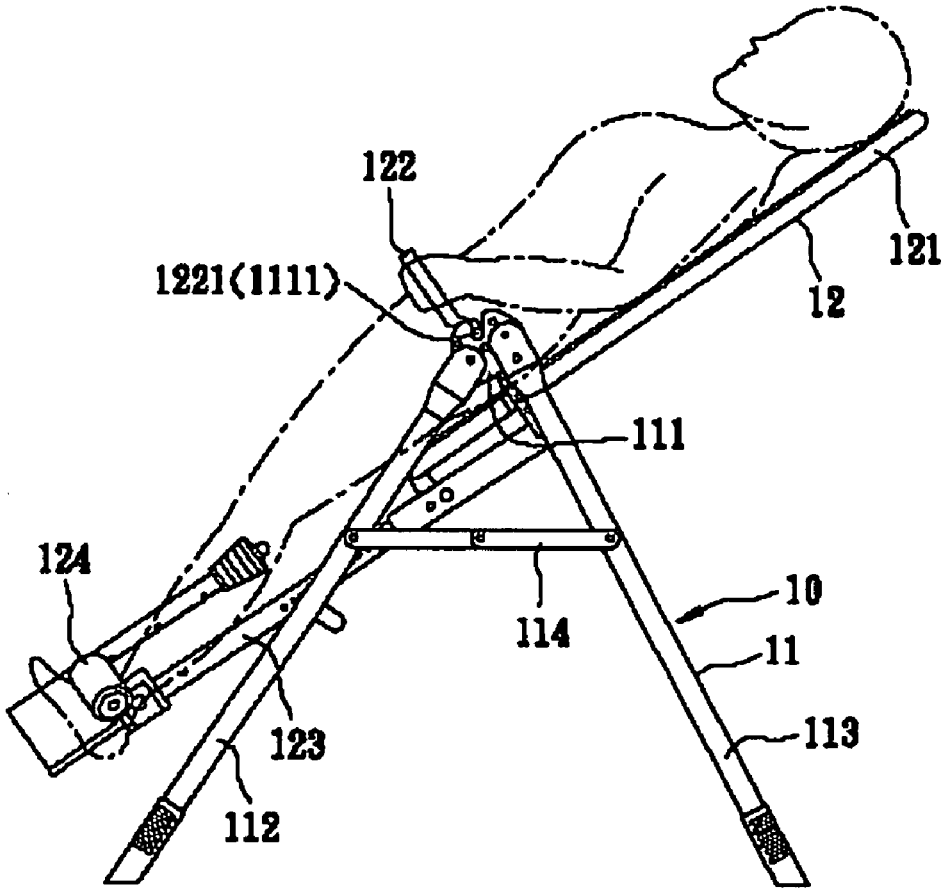
FIG. 1 (Prior Art)
FIG. 1 depicts the operation of a known inverting machine, of the prior art.
Figure 2:
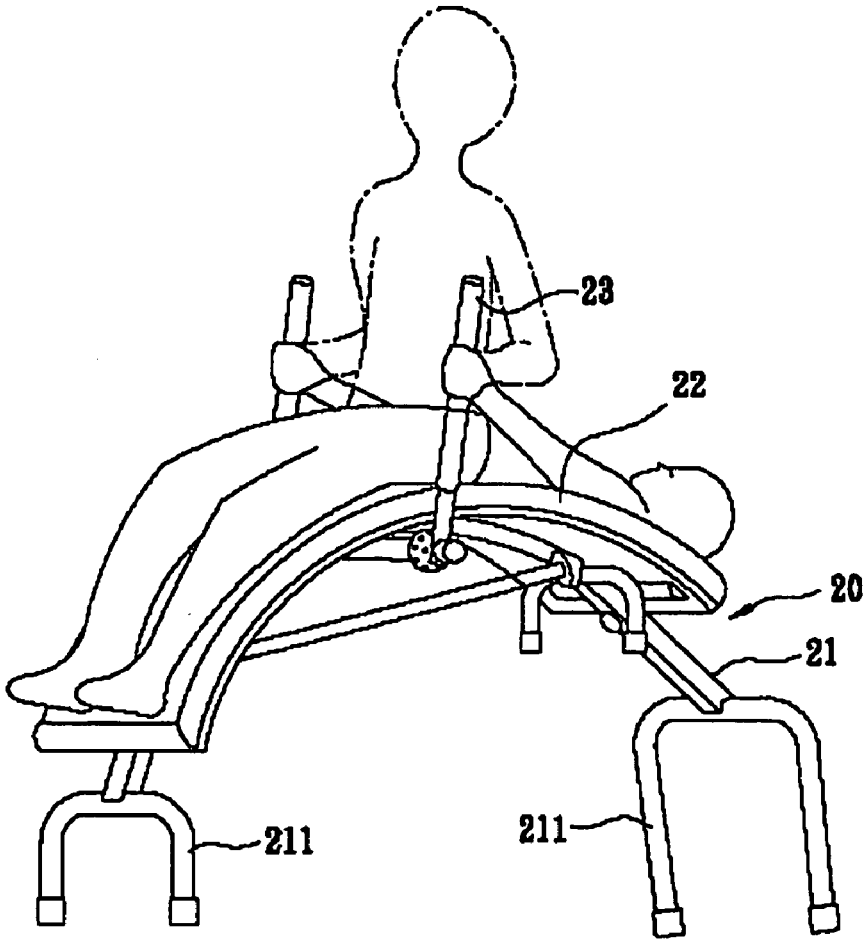
FIG. 2 (Prior Art)
FIG. 2 depicts the operation of a known back arching machine, of the prior art.
Figure 3:
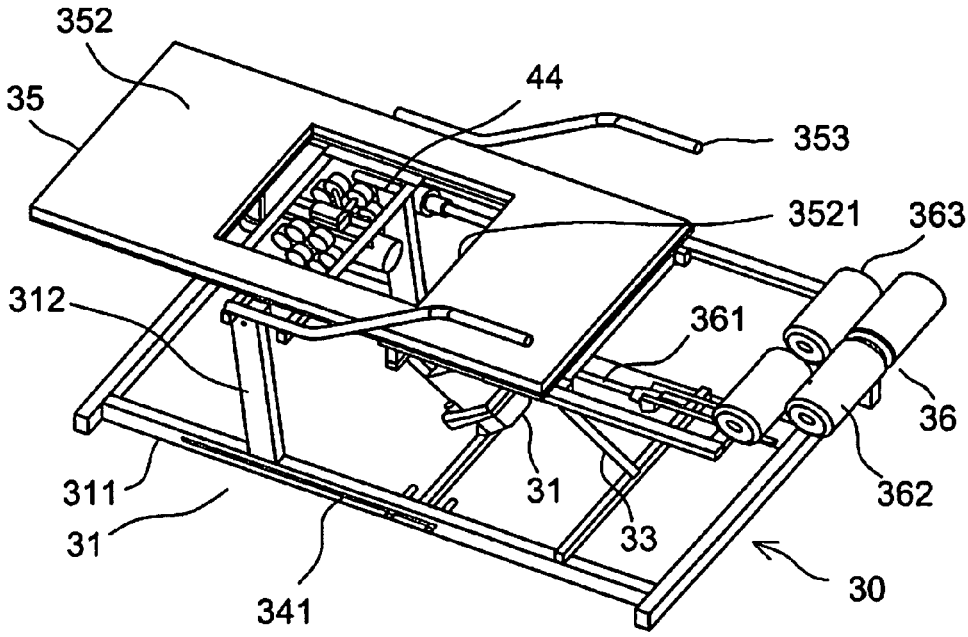
FIG. 3 depicts the isometric view of a first preferred embodiment of a spine stretch machine, showing an inverting part, and a back stretch part.
Figure 4:
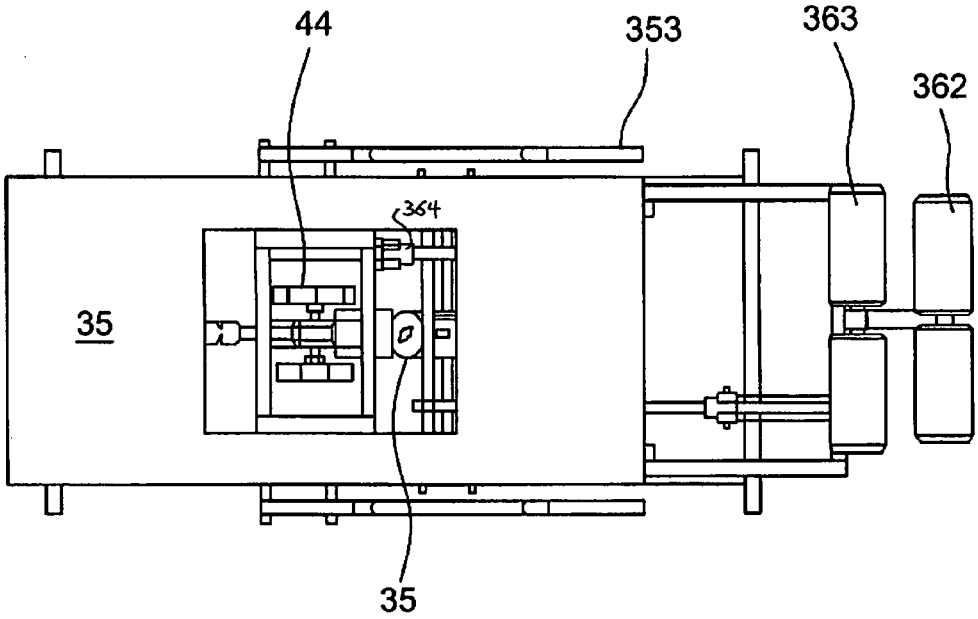
FIG. 4 depicts the top view of the first preferred embodiment, showing a platform and a rectangular opening in the middle of the platform.

Referring to the accompanying drawings in greater detail, as best illustrated in FIG. 3 and FIG. 4, in a first preferred embodiment of the present invention, a spine stretch machine includes a base 30. The base 30 has a frame 31, an inversion motor 32, a gas shock 33, a safety release device, a platform 35, and a foot anchor 36. The frame 31 has base stand members 311, and two vertical post stands 312 connected to the base stand members 311 and to the platform 35 through an axis 313. The inversion motor 32 rotates an inversion linkage 321, which links the frame 31 with the platform 35 anterior to the axis 313, around a sliding bar 342 to move the platform 35 from horizontal to vertical around the axis 313. The gas shock 33 linking the frame 31 with the platform 35 posterior to the axis 313 makes the inversion movement smoother. The safety release device consists of two safety release sliding rails 341 parallel to each other on the frame 31, the sliding bar 342, and a safety spring 343. If the inversion motor 32 is broken, the sliding bar 342 sliding along the safety release sliding rails 341 together with the safety spring 343 can bring the platform 35 from vertical back to horizontal. The platform 35 has a platform board 352 a person can lie on with a rectangular opening 3521 where the spine lies, two handles 353 connected to the platform frame. The feet anchor 36 has a feet anchor extension, a feet stopper 362 at the end of the feet anchor extension, an ankle stopper 363, and a leg adjustment motor 364 which can move the feet anchor extension close or away from the platform 35.

The platform 35 typically includes upholstery or other comfortable fabric allow a user to lie on the bed platform 35. If the upholstery is removed, the mechanism can be seen more clearly such as in FIG. 3.

The FIG. 3 sliding bar 342 is shown in the track in the first position which is for ordinary use. The sliding bar moves to the second position on the track when the motor is stuck or not functioning properly. Moving the sliding bar to the second position allows the user to return to horizontal position. The activation of the safety device has to be a smooth action and within some reasonable amount of time. Grasping the foot stopper 362 of the foot assembly 36 with the foot for an extended amount of time can be uncomfortable, or painful.

The sliding bar is actuated by a release mechanism where energy stored in a helical spring or compressed gas in shock 343 is released to push. The release member 343 when released using an activation mechanism pushes the sliding bar 342 and motor 32 to the release position from the first position. The activation mechanism can be mechanical such as a pull cord connected to a mechanical switch, or the activation mechanism can be an electrical such as connecting an emergency release button to the tip of handle 353. The emergency release button can be formed in a circular profile and recessed into the handle 353. Once the user presses the button or pulls on the cord, the release member 343 provides the biasing force to release the user back to horizontal position.

The second preferred embodiment of the present invention shows the roller massage unit. A variety of roller massage units 44 can be used in this apparatus. The prior art shows a wide variety of roller configurations, all of which can be used on the first preferred embodiment of the present invention. It is well known to a person of ordinary skill in the art to provide a roller massage mechanism on a massage chair. These roller mechanisms are typically interchangeable, or could be made interchangeable.

Figure 5:
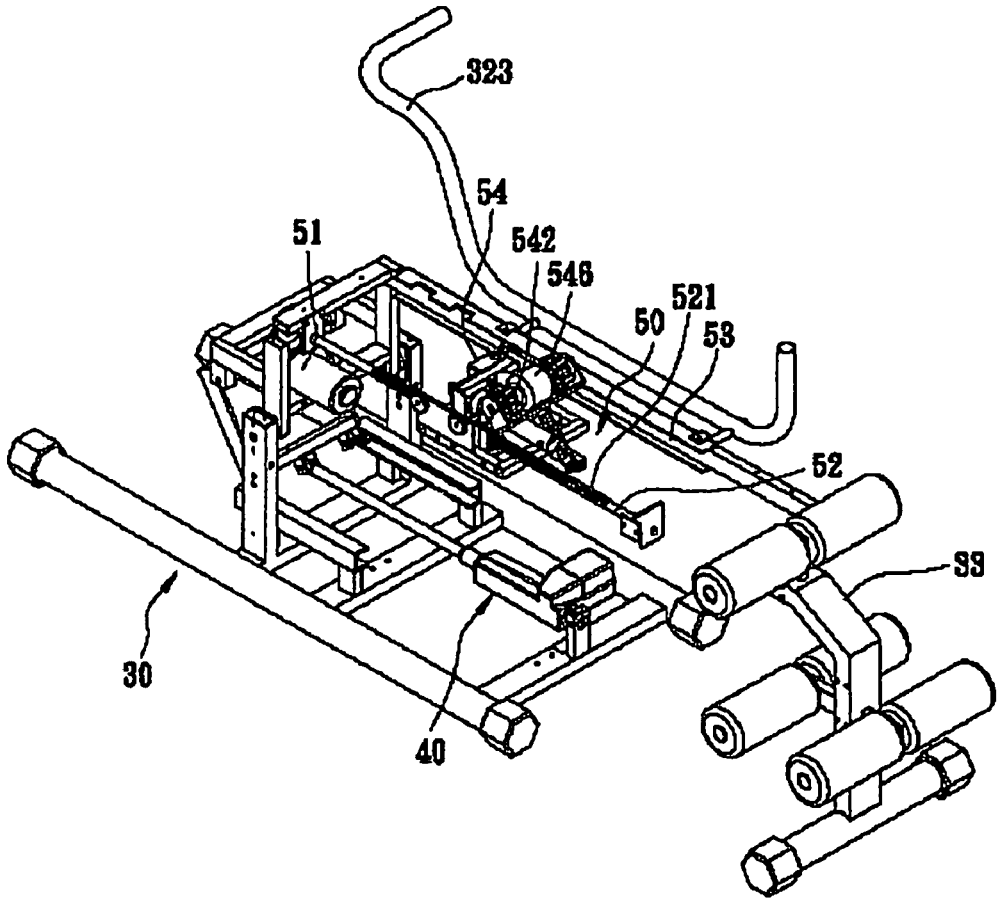
FIG. 5 depicts the isometric view of the back press unit, showing the roller part.

As best illustrated in FIG. 5, in a second preferred embodiment of the present invention, the back massager roller unit has a central drum massager 5461 and side roller massagers 5462. The triple unit 546 massages the spine as well as the area to the left and right of the spine. The triple unit 546 is mounted to a carrier 544 that is powered by a roller motor 543 and mounted on angular support member 545 that can move to raise or lower the triple unit 546 and press the triple unit into the back. An angular support member motor 542 moves the unit up or down while the roller motor 543 rotates the rollers. All of the roller units are mounted on cross frame 54 and perpendicular cross frame 541. The particular configuration of the roller heads is well known in the art and thus need not be further discussed herein.

Figure 6:
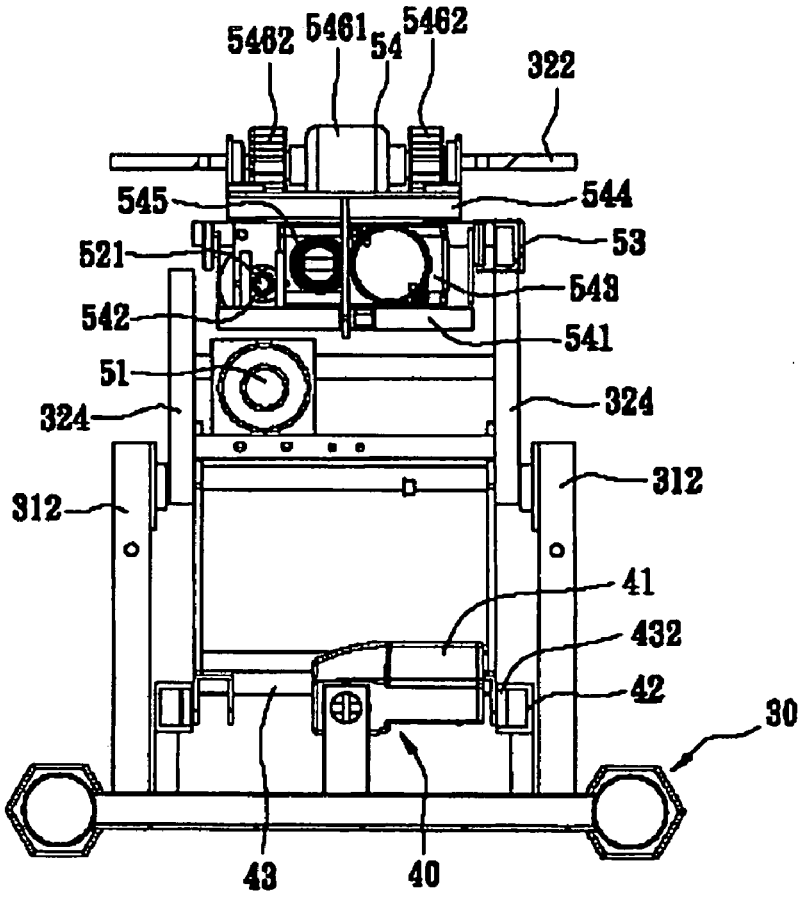
FIG. 6 depicts the operation of the first preferred embodiment, showing a user lying on his back on the platform in the horizontal position.

As shown in FIG. 6, in order to invert, a person first lies his upper body on the platform 35, holds the handles 353 comfortably with both hands, anchor his feet between the feet stopper and the ankle stopper, turn on the leg adjustment motor to adjust the distance between the platform 35 and the feet anchor to make his legs straight, thus stabilizing his body on the platform.

Figure 10:
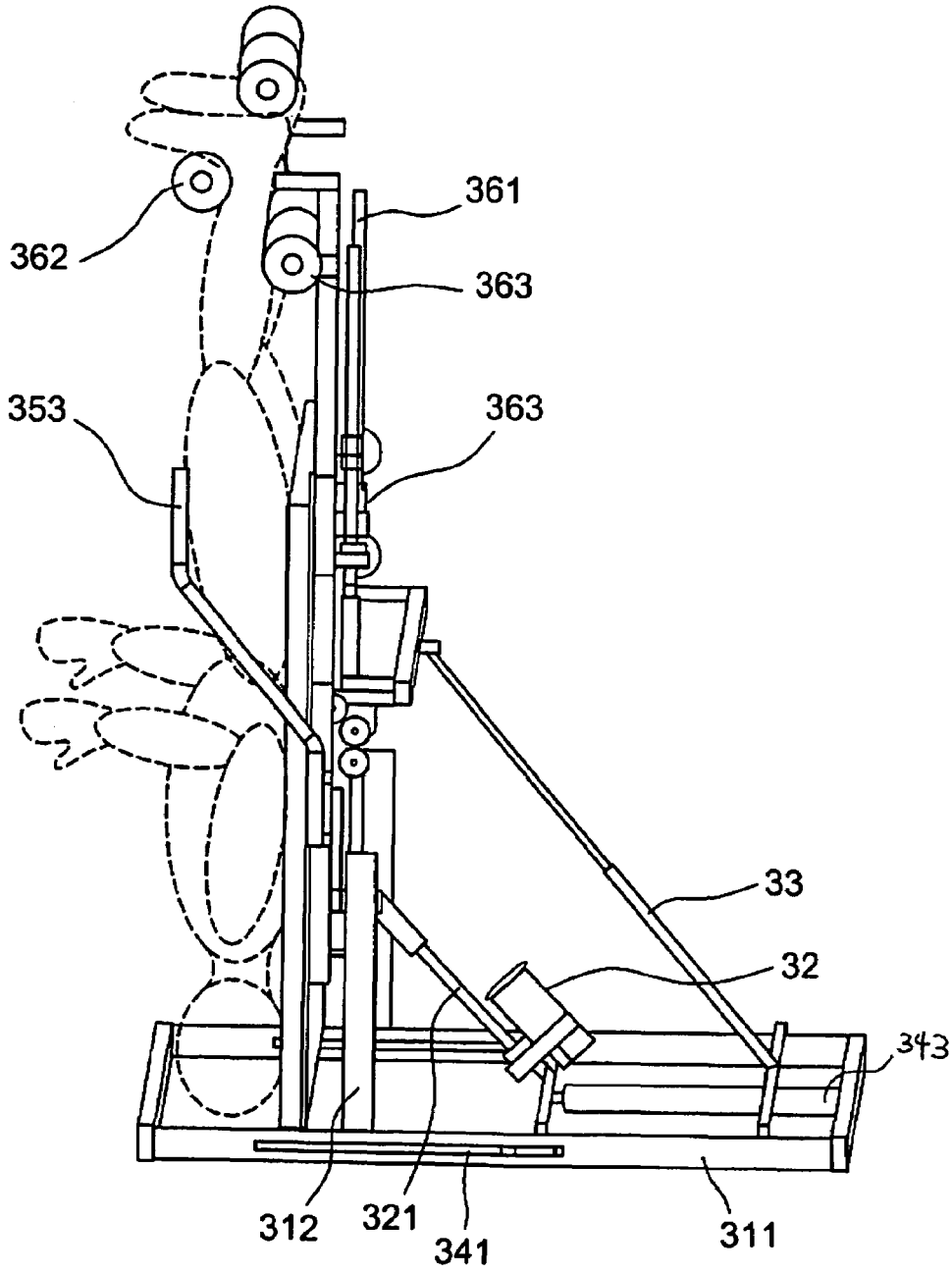
FIG. 10 is a diagram of the present invention in inverting position.
Figure 11:
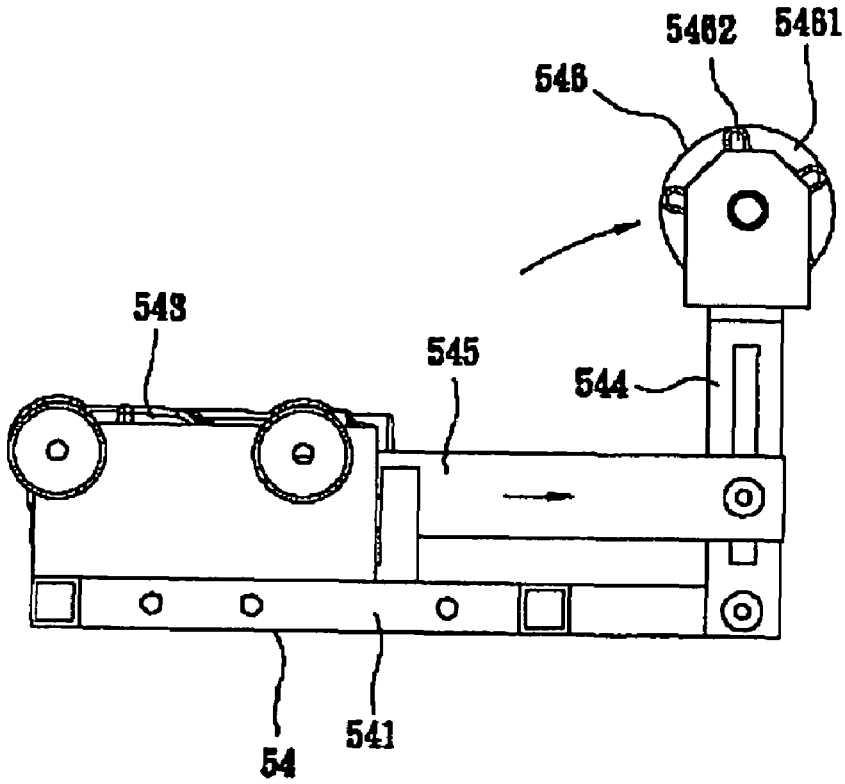
FIG. 11 is a diagram of the back roller.
Figure 12:
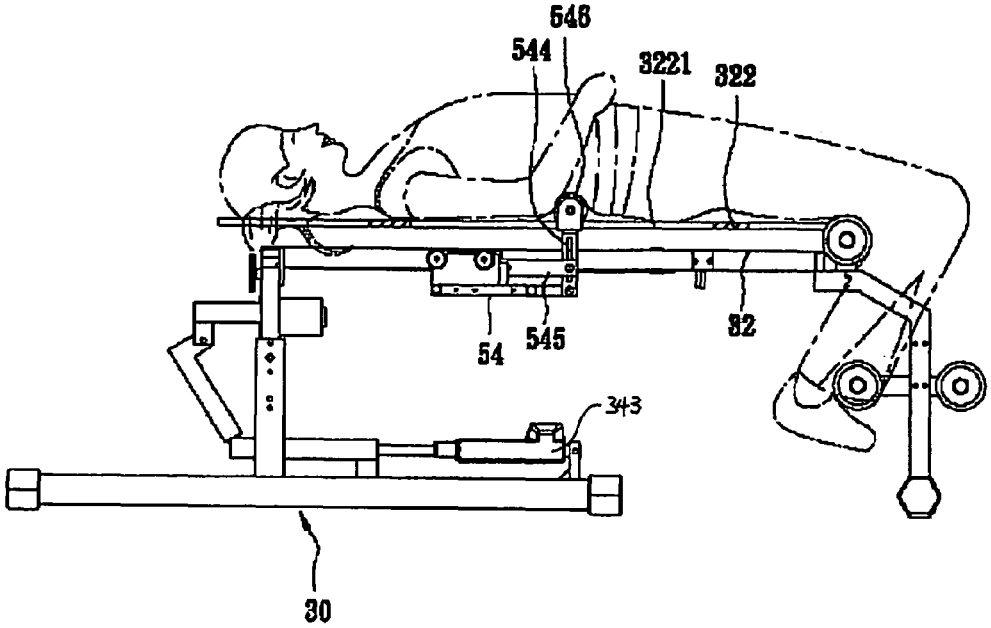
FIG. 12 is a diagram of the operation of the back roller.
Figure 13:
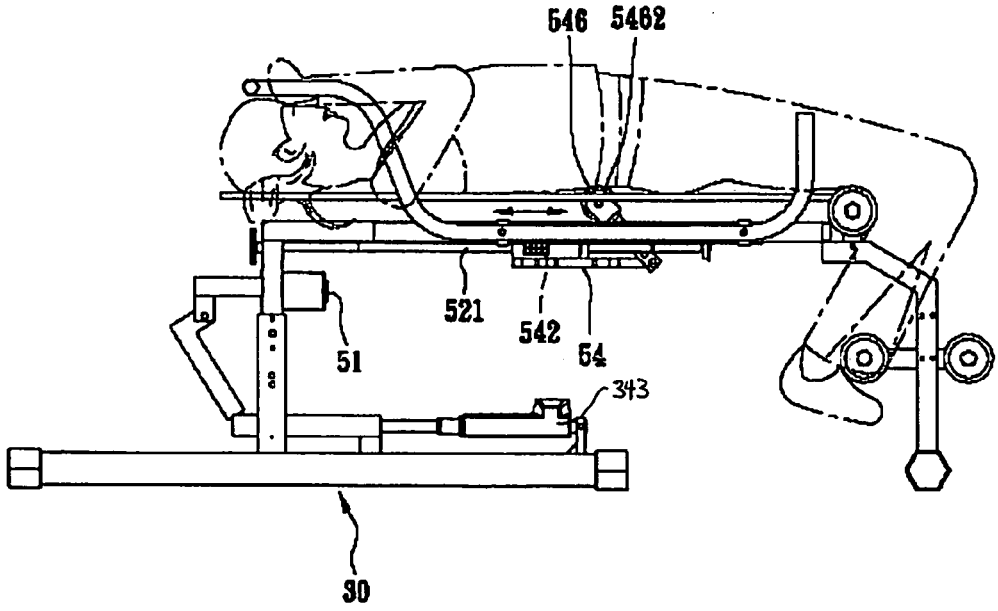
FIG. 13 is a diagram of the operation of the back roller.
Figure 14:
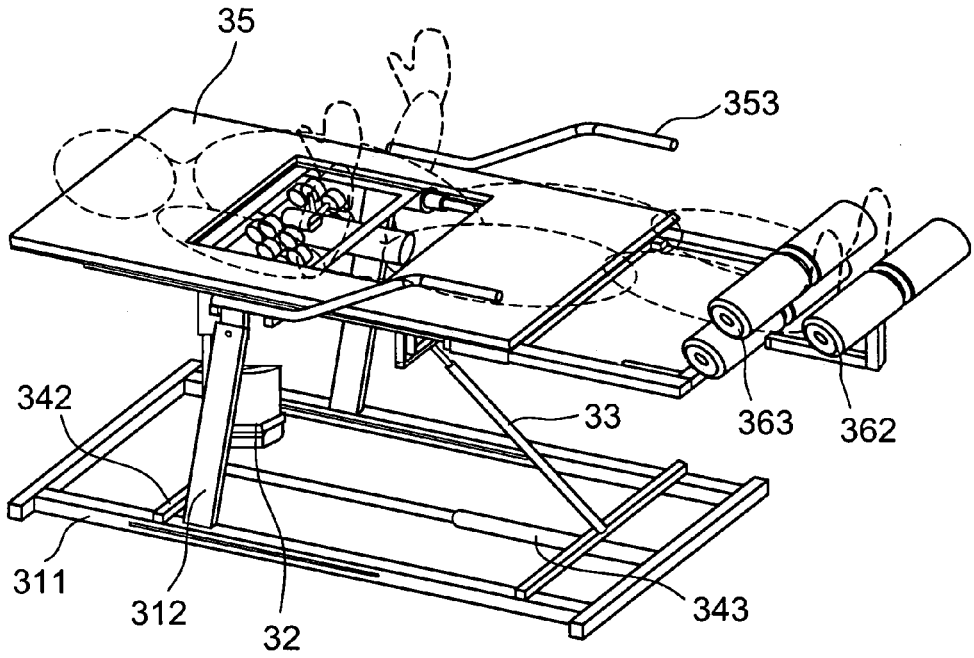
FIG. 14 is a perpective view of the present invention.

Then, as shown in FIG. 10, after turning on the inversion motor 32, the inversion motor 32 rotates the inversion linkage 321 around the sliding bar 342 to move the platform from horizontal to vertical around the axis. The gas shock 33 makes the inversion movement smoother. This will invert the user to stretch his spine. In order to receive a pressing stretch massage on the back, the user turns on the motor in the back press unit to receive a massage that can be designed from any number of commonly and commercially available massaging rolling devices.

Figure 8:
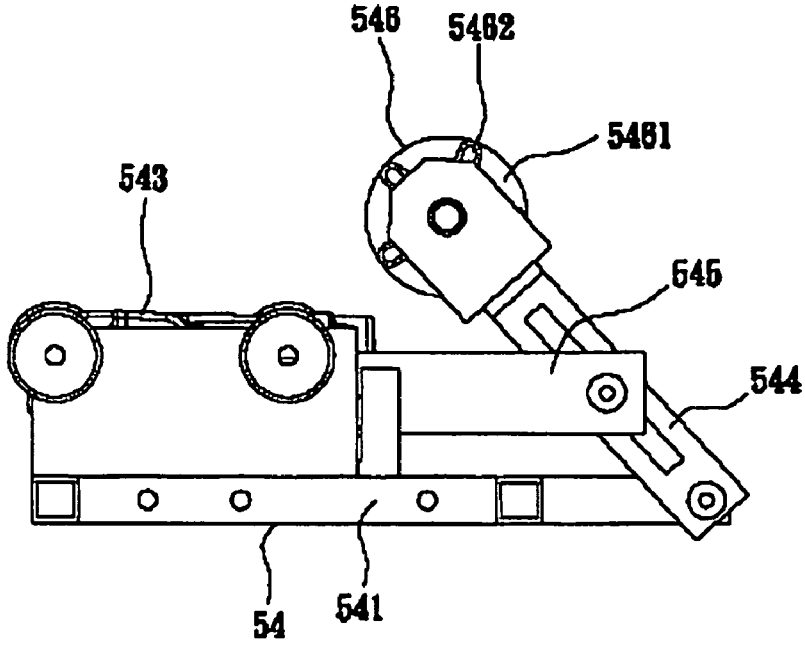
FIG. 8 depicts the operation of the first preferred embodiment when the inversion motor is broken, showing a safety release device can bring an inverted user back to horizontal position.
Figure 9:
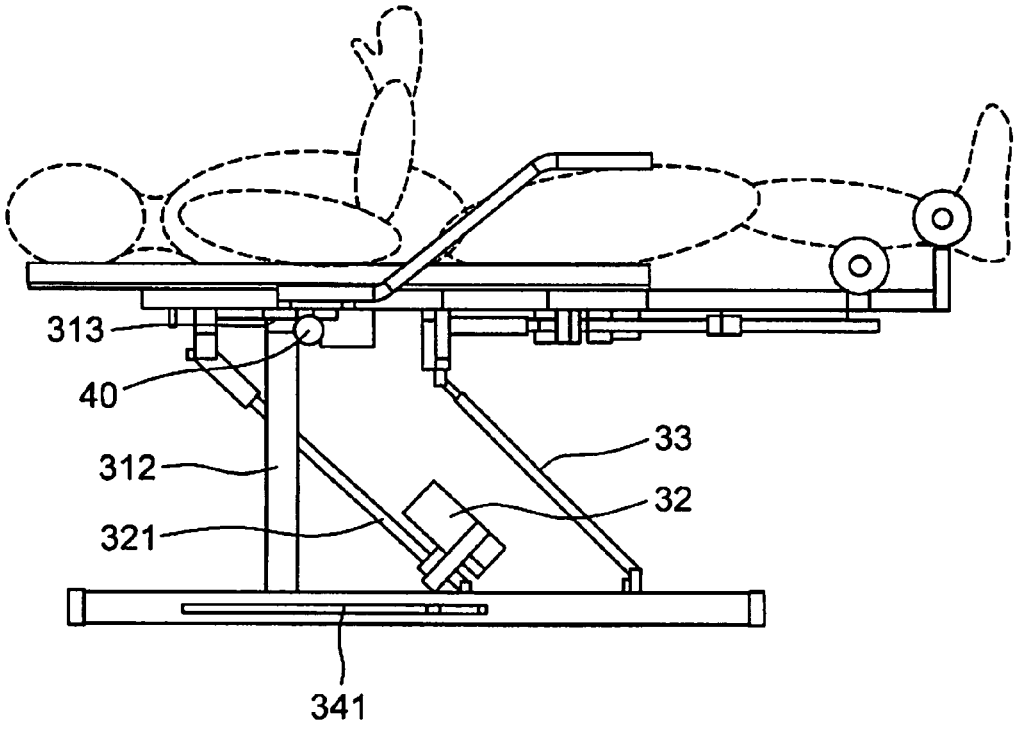
FIG. 9 is a diagram of the present invention in starting position.

As shown in FIG. 8, if the inversion motor 32 is broken, the sliding bar 342 slides forward along the safety release sliding rails 341 together with the safety spring or shock 343 to bring the platform 35 from vertically back to horizontally. The sliding bar 342 sliding along the safety release sliding rails 341 has an activation device such as an electronic pushbutton or other equivalent mechanical means. As can be seen in FIG. 8, the mechanism is in the recovered position which occurs when the inverting motor 32 is not operational. The rails 341 can be formed in the basic frame members 311 such as by cutting a slot into the metal frame.

The handle 353 can contain an activation mechanism such as a push button or pull cord providing release of biasing force in the spring or shock member 343. A number of commonly and commercially available activation mechanisms can activate the shock spring 343 so that it slowly pushes the sliding bar 342 on the rail 341 to allow the user to return back to horizontal position. Because a wide variety of activation mechanisms are commonly known, any of them can be used and need not be further described in detail in this specification.

Figure 7:
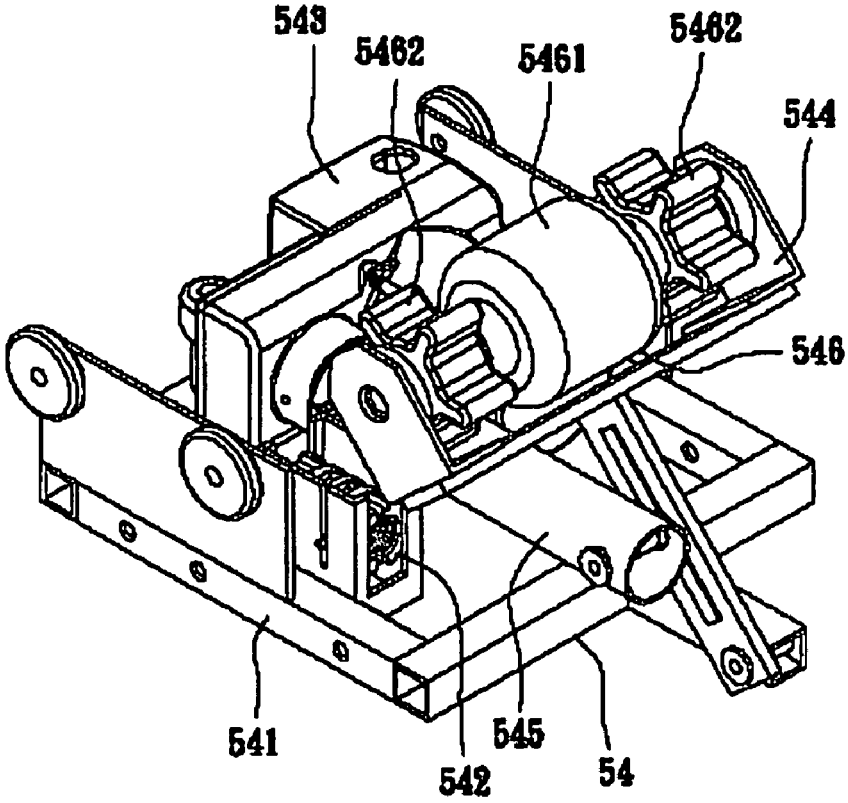
FIG. 7 depicts the operation of the first preferred embodiment, showing a user lying on the platform in the vertical position to receive back stretch, press and massage.

The safety spring should preferably have integrated shock with it so that the user does not have a rough ride. The safety spring 343 preferably is a gas shock that holds compressed air which is, when activated, pushing the inversion linkage so that the user returns to horizontal position. The safety spring can also be a helical spring, but this is not preferred unless a shock is also mechanically connected to it so that the user does not have a rough ride back to horizontal position. A wide variety of springs can be used such as a cantilever spring. Also, the spring can be mounted in a different position such as opposite with the current configuration shown in FIG. 7 such that it pulls instead of pushes. A motor can also provide a spring force, but this would require additional cost and complication which is not preferred.

Since above embodiments describe but not limit the present invention, additional variations or modifications of the present invention based on specification or claims do not depart from the inventive concept.

The invention claimed is:

1. A spine stretch machine, comprising:

a. a base frame;

b. an inverting frame mounted in swivel connection to the base frame;

c. a feet anchor on the inverting frame allowing the user to invert;

d. an inversion motor that rotates a platform between a horizontal position and a vertical position around an axis via an inversion linkage connected to the inversion motor and a sliding bar;

e. a back massaging portion having rollers for rolling the back of the user's body;

and;

f. a safety device comprising:

i. a sliding rail formed on the base frame, wherein the inversion linkage is mechanically connected to the sliding rail and is at a first position on the sliding rail during normal operation;

ii. a spring that when activated moves the inversion linkage relative to the base frame to restore the user back to horizontal position by sliding the inversion linkage from the first position on the sliding rail to a second position on the sliding rail so that the platform travels from the vertical position to the horizontal position;

iii. wherein the sliding bar slides forward along the sliding rails together with a safety shock to bring the platform from vertically back to horizontally;

wherein the inversion motor is mounted to the sliding rail at a rear position during normal operation, and wherein the inversion motor slides to a forward position when the safety device is activated.

2. The spine stretch machine in claim 1, wherein a gas shock links the inverting frame with the base frame.

3. The spine stretch machine in claim 2, wherein back massaging portion has motorized rollers.

4. The spine stretch machine in claim 2, wherein the feet anchor has a feet anchor extension, a feet stopper and an ankle stopper.

5. The spine stretch machine in claim 2, wherein the platform has two handles.

6. The spine stretch machine in claim 2, wherein a rolling part includes two massage wheels on both sides.

7. The spine stretch machine in claim 6, wherein back massaging portion has motorized rollers.

8. The spine stretch machine in claim 6, wherein the feet anchor has a feet anchor extension, a feet stopper and an ankle stopper.

9. The spine stretch machine in claim 6, wherein the platform has two handles.

10. The spine stretch machine in claim 9, wherein the feet anchor has a feet anchor extension, a feet stopper and an ankle stopper.

11. A spine stretch machine, comprising:

a base frame;

an inverting frame mounted in swivel connection to the base frame on an axis;

a feet anchor on the inverting frame allowing the user to invert;

and inversion motor of us that rotates a platform between a horizontal position and a vertical position around the axis via an inversion linkage connected between the base frame and the inverting frame;

a back massaging portion having rollers for rolling the back of the user's body; and a safety device comprising: a sliding rail formed on the base frame, wherein the inversion linkage is mechanically connected to the sliding rail and is at a first position on the sliding rail during normal operation; a spring that when activated moves the inversion linkage relative to the base frame to restore the user back to horizontal position; wherein back massaging portion has motorized rollers, wherein the user is moved that to horizontal position by sliding the inversion linkage from the first position on the sliding rail to a second position on the sliding rail so that the platform travels from the vertical position to the horizontal position; wherein the sliding bar slides forward along the sliding rails together with a safety shock to bring the platform from vertically back to horizontally; wherein the inversion motor is mounted to the sliding rail at a rear position during normal operation, and wherein the inversion motor slides to a forward position when the safety device is activated.

12. The spine stretch machine in claim 11, wherein the feet anchor has a feet anchor extension, a feet stopper and an ankle stopper.

13. The spine stretch machine in claim 11, wherein a rolling part includes two massage wheels on both sides.

14. The spine stretch machine in claim 13, wherein the platform has two handles.

15. The spine stretch machine in claim 11, wherein the platform has two handles.

16. The spine stretch machine in claim 15, wherein the feet anchor has a feet anchor extension, a feet stopper and an ankle stopper.

17. The spine stretch machine in claim 15, wherein a rolling part includes two massage wheels on both sides.

18. A spine stretch machine, comprising:

a base frame;

an inverting frame mounted in swivel connection to the base frame;

a feet anchor on the inverting frame allowing the user to invert, wherein a platform rotates between a horizontal position and a vertical position around an axis via an inversion linkage connected to an inversion motor and a sliding bar;

a back massaging portion having rollers for rolling the back of the user's body; and a safety device comprising: a sliding rail formed on the base frame, wherein the inversion linkage is slidingly mechanically connected to the sliding rail at a linkage lower end and is at a first position on the sliding rail during normal operation; wherein when the safety device is activated moves the inversion linkage relative to the base frame to restore the user back to horizontal position by sliding the inversion linkage from a first position on the sliding rail to a second position on the sliding rail so that the platform travels from the vertical position to the horizontal position to allow a user to escape; wherein the sliding bar slides forward along the sliding rails together with a safety shock to bring the platform from vertical back to horizontal; wherein the inversion motor is mounted to the sliding rail at a rear position during normal operation, and wherein the inversion motor slides to a forward position when the safety device is activated.

* * * * *